US005828967A

United States Patent [19]

Ueda

[11] Patent Number: 5,828,967

[45] Date of Patent: Oct. 27, 1998

[54] CONTROL DEVICE FOR ENGINE COMPARTMENT COOLING

[75] Inventor: Yoshiaki Ueda, Fuji, Japan

[73] Assignee: Jatco Corporation, Japan

[21] Appl. No.: 574,431

[22] Filed: Dec. 15, 1995

[30] Foreign Application Priority Data

Dec. 28, 1994 [JP] Japan ..... 6-339054

[51] Int. Cl.[6] ..... F01P 7/12; F01P 11/10

[52] U.S. Cl. ..... 701/1; 701/101; 701/112; 123/41.05; 123/41.12; 123/41.39

[58] Field of Search ..... 701/1, 112, 101; 123/41.12, 41.49, 41.31, 41.05; 318/471, 473, 447

[56] References Cited

U.S. PATENT DOCUMENTS

| | | | |
|---|---|---|---|
| 4,168,456 | 9/1979 | Isobe | 318/471 |
| 4,409,933 | 10/1983 | Inoue | 318/471 |
| 4,774,910 | 10/1988 | Aihara et al. | 922/12 |
| 4,930,460 | 6/1990 | Aihara et al. | 123/41.49 |
| 4,977,743 | 12/1990 | Aihara et al. | 123/41.31 |
| 4,977,862 | 12/1990 | Aihara et al. | 123/41.12 |
| 5,144,916 | 9/1992 | Yoshida et al. | 123/41.15 |
| 5,413,072 | 5/1995 | Andersen et al. | 123/145 A |
| 5,505,165 | 4/1996 | Kimoto | 123/41.01 |

FOREIGN PATENT DOCUMENTS

| | | |
|---|---|---|
| 0 323 210 | 5/1989 | European Pat. Off. . |
| 0 323 211 | 5/1989 | European Pat. Off. . |
| 3229003C2 | 3/1983 | Germany . |
| 2-112611 | 5/1990 | Japan . |

*Primary Examiner*—Tan Q. Nguyen
*Attorney, Agent, or Firm*—Rossi & Associates

[57] ABSTRACT

An engine compartment cooling fan provided in an engine compartment is controlled by a control unit, to be placed in its ON or OFF state, on the basis of an output from an engine compartment temperature sensor. The control unit continues the control of the engine compartment fan for a predetermined period of time after a key switch is turned off, with power supplied from a battery through a by-pass line. This permits the engine to be re-started without difficulty even after a short time of stop of the vehicle. Upon lapse of the predetermined time, the control unit disconnects the power supply through the by-pass line and stops its operation. Since there is no power consumption after the end of the operation of the cooling fan, unnecessary consumption of the battery can be avoided.

1 Claim, 7 Drawing Sheets

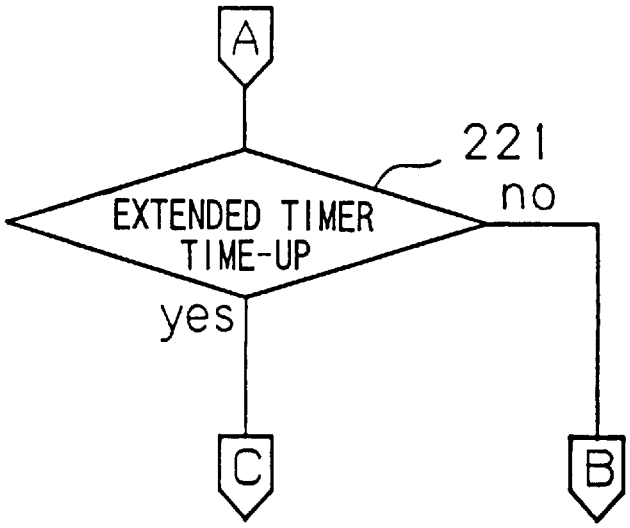
Fig.5B
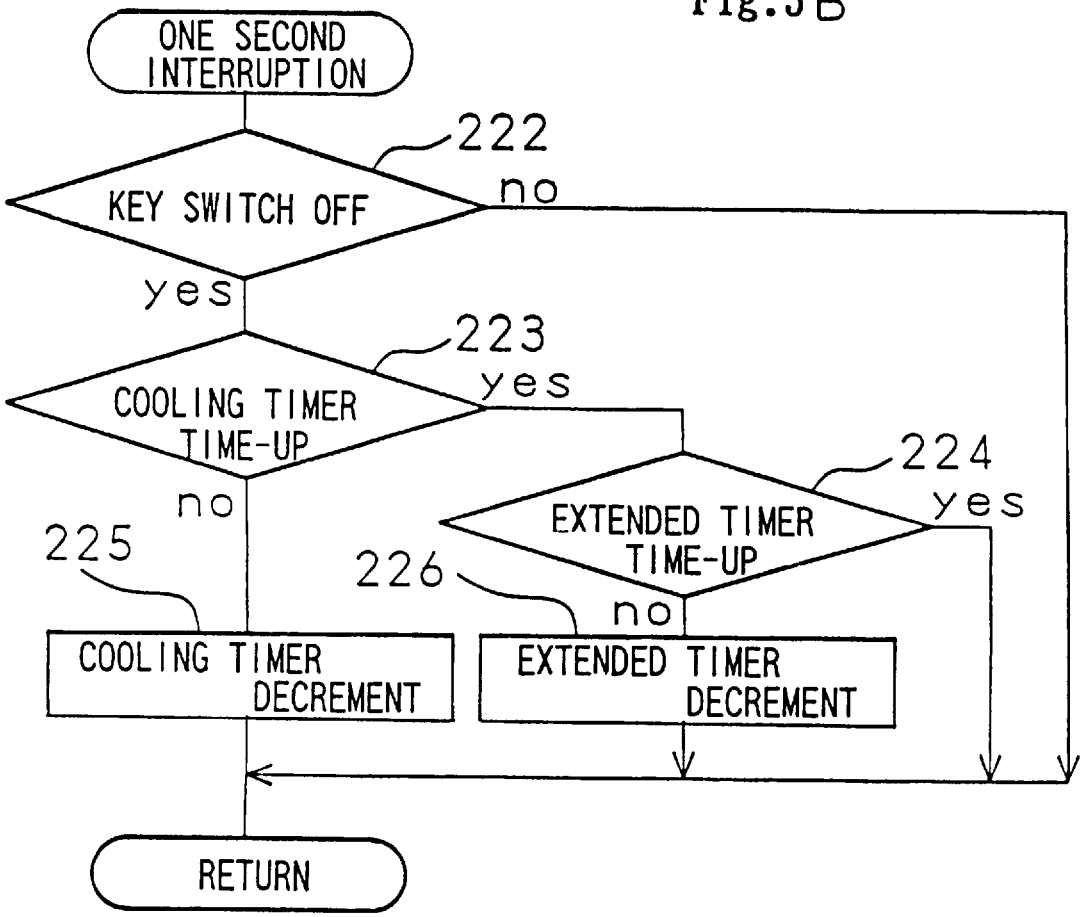

CONTROL DEVICE FOR ENGINE COMPARTMENT COOLING

BACKGROUND OF THE INVENTION

1. Field of the Invention

The present invention relates to a control device for an automobile, which is actuated with an electric power supplied from an on-vehicle battery through a key switch circuit, for controlling drive and stop modes of an on-vehicle equipment.

2. Description of the Prior Art

Small-sized integrated circuit control devices have been installed in automobiles. The control devices for an automobile include, for example, an engine controller for controlling a vehicle engine, an AT controller for controlling an automatic transmission, a brake controller for controlling brake systems, a general purpose computer for controlling a navigation system or an on-vehicle audio unit, and the like.

These control devices are actuated with electric power supplied from an on-vehicle battery through a key switch, for controlling drive and stop modes and on-time operating states of the relevant on-vehicle equipment. Namely, the conventional control devices receive electric power from the on-vehicle battery through a key switch circuit. When the key switch of the automobile is turned off, therefore, all the control devices are disconnected from the power supply and stopped, and the on-vehicle equipment whose ON and OFF states are controlled by the control devices stops its operation.

In some cases, a particular on-vehicle equipment is desired to be actuated after the key switch is turned off. For example, it is desired to cool an engine compartment after an engine is stopped. More specifically, a radiator or a cooling fan stops operating at the same time that the key switch is turned off, resulting in a temperature rise in the engine compartment. This causes some fuel to be vaporized and generates bubbles in fuel injection pumps or fuel pipes, whereby it takes more time to re-start the engine after it is stopped only for a short time. This problem is addressed in Japanese Patent Application Laid-open No. 2-112611.

To solve the above problem, it is proposed in the Japanese Patent Application Laid-open No. 2-112611 to rotate the radiator cooling fan in a reverse direction after the key switch is turned off, so as to exhaust a high-temperature air in the engine compartment, until the temperature in the engine compartment becomes equal to or lower than a predetermined level.

In the above-identified publication, however, there is no description of a power source for a controller device for controlling ON and OFF states of the radiator cooling fan. The controller is considered to be connected directly with the on-vehicle battery, for example, so as to keep controlling the radiator cooling fan after the key switch is turned off. In this case, however, electric current unnecessarily keeps flowing from the on-vehicle battery to the controller even after the temperature in the engine compartment is lowered down to a predetermined value or less, and the cooling fan is stopped. Consequently, the on-vehicle battery may be exhausted before the key switch is turned on next time, making it difficult to start the engine.

Other than the above technique of directly connecting the control device to the on-vehicle battery, there may be considered some methods for enabling the operation of a particular on-vehicle equipment after the key switch is turned off. The methods include: (1) connecting the control device in charge of controlling the on-vehicle equipment to be operated, directly with the on-vehicle battery, and operating the on-vehicle equipment irrespective of the ON and OFF states of the key switch; (2) providing a switch circuit equipped with an OFF timer, for supplying an electric power from the on-vehicle battery directly to the on-vehicle equipment, and starting the OFF timer at the same time that the key switch is turned off; and (3) providing an exclusive control device for the on-vehicle equipment to be operated, and connecting this control device directly with the on-vehicle battery to operate the equipment irrespective of the ON and OFF states of the key switch.

The above three methods for operating a particular on-vehicle equipment after switch-off of the key switch suffer from the following problems: (1) where the control device in charge of controlling the on-vehicle equipment to be operated is connected directly with the on-vehicle battery, the control device keeps consuming an electric power stored in the on-vehicle battery even after the key switch is turned off, which may result in exhaustion of the on-vehicle battery by the time when the key switch is turned on next time; (2) where the switch circuit equipped with the OFF timer is provided for directly supplying an electric power from the on-vehicle battery to the particular on-vehicle equipment, the equipment simply continues its operation for a fixed period of time, and cannot be precisely or subtly controlled, using sensor outputs and other parameters; and (3) where the exclusive control device for the on-vehicle equipment to be operated is provided, electric power supplied from the on-vehicle battery can be limited by use of a program for reducing power consumption, for example. The addition of an exclusive a control system, however, results in an increased cost, a complicated wiring system in the vehicle, and complicated connections between conventional sensors and the control system.

When an OFF timer is used to control an exhaust fan adapted to exhaust a high-temperature air in an engine compartment to the outside of the vehicle, the exhaust fan is operated even when the temperature in the engine compartment is sufficiently low and cooling is unnecessary, resulting in a waste of the battery capacity. Further, the addition of the timer requires an installation space for the timer and a considerable change in the wiring, for example, which eventually increases manufacturing cost and time.

SUMMARY OF THE INVENTION

It is therefore an object of the present invention to provide a control device for an automobile, which minimizes electric power to be supplied from an on-vehicle battery for operating a particular on-vehicle equipment after a key switch is turned off, and which requires minimum addition and changes in circuit construction and programs for continuing control of the on-vehicle equipment after the key switch is turned off.

A control device for an automobile according to one preferred embodiment includes a first switching circuit for permitting and inhibiting power supply to an exhaust fan for exhausting air in an engine compartment, a processing block for controlling ON and Off states of the first switching circuit, and a power source circuit for forming a source voltage of the processing block, out of electric power of an on-vehicle battery supplied through a key switch, a temperature sensor for detecting a temperature level in the engine compartment, a power source sensor for generating an output corresponding to one of ON and OFF states of the key switch, and a second switching circuit provided between the on-vehicle battery and the power source circuit, for permitting power supply through a by-pass line to the power source circuit in response to a command from the processing block.

In this control device, the processing block executes a first processing step for turning on the second switching circuit before the key switch is turned off, a second processing step for turning on and off the first switching circuit on the basis of an output of the temperature sensor, a third processing step for determining the ON and OFF states of the key switch on the basis of an output of the power source sensor, and a fourth processing step for turning off the second switching circuit after the exhaust fan is kept controlled for more than several minutes according to the second processing step, when the key switch is determined to be in the OFF state by the third processing step.

In the control device constructed as described above, the exhaust fan is kept controlled after the key switch of the automobile is turned off, so as to force high-temperature air out of the engine compartment. With the processing block turning on and off the first switching circuit according to a control program stored therein, electric power is supplied to the exhaust fan even after the key switch is turned off.

The processing block is actuated with a source voltage supplied from the power source circuit. This processing block operates the exhaust fan for more than several minutes after the key switch is turned off, and then stops the fan at an appropriate time. The processing block also turns off the second switching circuit for effecting power supply to the power source circuit, and thus terminates its own operation.

The processing block starts the exhaust fan depending upon the timing of turning-on of the key switch, starting of the engine, and the temperature rise in the engine compartment, for example, and stops the exhaust fan upon lapse of the predetermined time or depending upon the timing of completion of the cooling.

The above-indicated fourth processing step may comprise: a processing step for starting a cooling timer of several minutes when the key switch is determined in the OFF state by the third arithmetic processing, and continuing control of the exhaust fan according to the second processing step, a processing step for turning off the second switching circuit if control of the exhaust fan is completed upon timeout of the cooling timer, but starting an extended timer of several minutes if the control is not completed, so as to further continue control of the exhaust fan according to the second processing step, a processing step for turning off the second switching circuit immediately after the control of the exhaust fan is completed during counting of the extended timer, and a processing step for turning off the second switching circuit upon timeout of the extended timer even if the control of the exhaust fan has not been completed.

The control device as described above effects accurate and subtle control of the exhaust fan, depending on a temperature rise and cooling characteristic of the engine compartment. Where the engine is stopped after the vehicle is operated for a sufficiently long time, the control of the exhaust fan is started during running of the vehicle. After the key switch is turned off, the exhaust fan is stopped when it is determined that the temperature in the engine compartment is lowered down to a predetermined limit level, or that a predetermined cooling time has passed.

Where the ambient temperature is extremely low or the vehicle is operated for a short time, on the other hand, the exhaust fan may be stopped due to a small temperature rise in the engine compartment when the key switch is turned off. Even in this case, the temperature in the engine compartment may be considerably elevated soon after the key switch is turned off, since no air flows through the engine compartment after the vehicle is stopped.

In the above case, the processing block detects the temperature rise and turns on the exhaust fan during counting of the cooling time, and turns off the fan when it determines that the cooling has been completed. If the cooling is not completed upon timeout of the cooling timer, the extended timer is then started. The exhaust fan is not kept controlled longer than the sum of the times set in the cooling timer and extended timer. That is, the exhaust fan is not operated unlimitedly, thus avoiding unnecessary consumption of the on-vehicle battery.

BRIEF DESCRIPTION OF THE DRAWINGS

The invention will be described in greater detail with reference to certain preferred embodiments thereof and the accompanying drawings, wherein:

FIG. 5A and 5B are flow charts of processing;

DETAILED DESCRIPTION OF THE PREFERRED EMBODIMENTS

Figure 1:
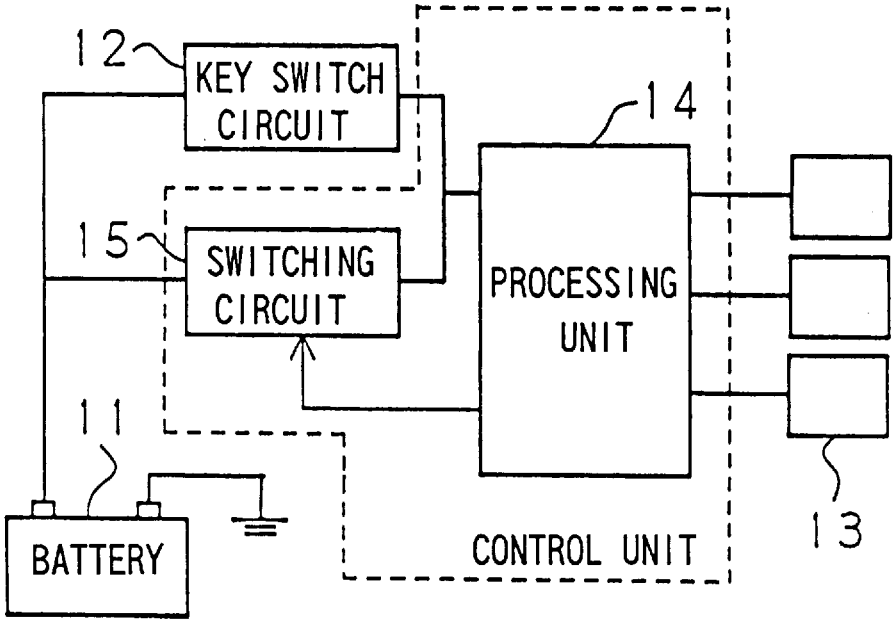
FIG. 1 is an explanatory view showing the construction of the present invention.

FIG. 1 is a view showing the general construction of the present invention. In a control device for an automobile including a processing unit 14 actuated with a power supply from an on-vehicle battery 11 through a key switch circuit 12, for controlling drive and stop modes of an on-vehicle equipment 13, a switching circuit 15 is provided between the on-vehicle battery 11 and the processing unit 14, for supplying an electric power to the processing unit 14 through a by-pass line, in response to a command from the processing unit 14, and the processing unit 14 stores a power source self-control program for keeping the processing unit 14 actuated with a power supply through the by-pass line and the switching circuit 15 after the key switch circuit 12 is turned off, and for turning off the switching circuit 15 upon completion of control of the on-vehicle equipment 13.

In the control device for an automobile constructed as described above, the processing unit 14 keeps operating with power supplied through the by-pass line and the switching circuit 15, even after a vehicle operator turns off a key switch of the automobile to place the key switch circuit 12 in the OFF state. The processing unit 14 continues to control drive and stop modes and other on-time operating states of the on-vehicle equipment 13, according to control programs stored therein.

After the key switch is turned off and when a desired operation of the on-vehicle equipment 13 is completed, the switching circuit 15 is turned off according to the power source self-control program, and the processing unit 14 terminates its own power consumption. Accordingly, the on-vehicle equipment 13 can be precisely or subtly controlled by the processing unit 14, on the basis of outputs from sensors and other devices, even after the key switch is turned off. After the switching circuit 15 is turned off according to the power source self-control program, the entire operation and power consumption of the processing unit 14 are completely stopped until the vehicle operator turns on the key switch again.

The power source self-control program may include a first processing step for determining one of ON and OFF states of the key switch circuit 12, a second processing step for continuing control of the drive and stop modes of the on-vehicle equipment 13 for a predetermined period of time after it is determined in the first step that the key switch circuit is in the OFF state, and, if the on-vehicle equipment needs to be in the drive mode, driving or operating the on-vehicle equipment 13 until it becomes unnecessary, and a third processing step for turning off the switching circuit 15 if it is determined unnecessary to drive the on-vehicle equipment 13 after the predetermined period of time.

In the above arrangement, the on-vehicle equipment 13 is kept controlled for a limited time after the key switch is turned off such that the equipment 13 is turned on and off depending on actual circumstances. The limited time is measured in a timer counting step in the control program. The processing unit 14 starts the timer counting when it determines that the key switch circuit 12 is turned off. The processing unit 14 then determines whether a predetermined time has elapsed or not, and continues the ON/OFF control of the on-vehicle equipment 13 if the predetermined time has not elapsed. Namely, the processing unit 14 keeps observing the circumstances during the predetermined time even if the on-vehicle equipment 13 is in the OFF state, and turns on the on-vehicle equipment 13 when it becomes necessary. If the on-vehicle equipment 13 is in the OFF state upon lapse of the predetermined time, the switching circuit 15 is turned off to terminate the above observation.

The switching circuit 15 may comprise a switching transistor controlled by the processing unit 14, and may be accommodated within the circuitry of the processing unit 14 as illustrated by the dotted line. In this case, electric power is supplied to the processing unit 14 through the switching transistor as the switching circuit 15.

Figure 2:
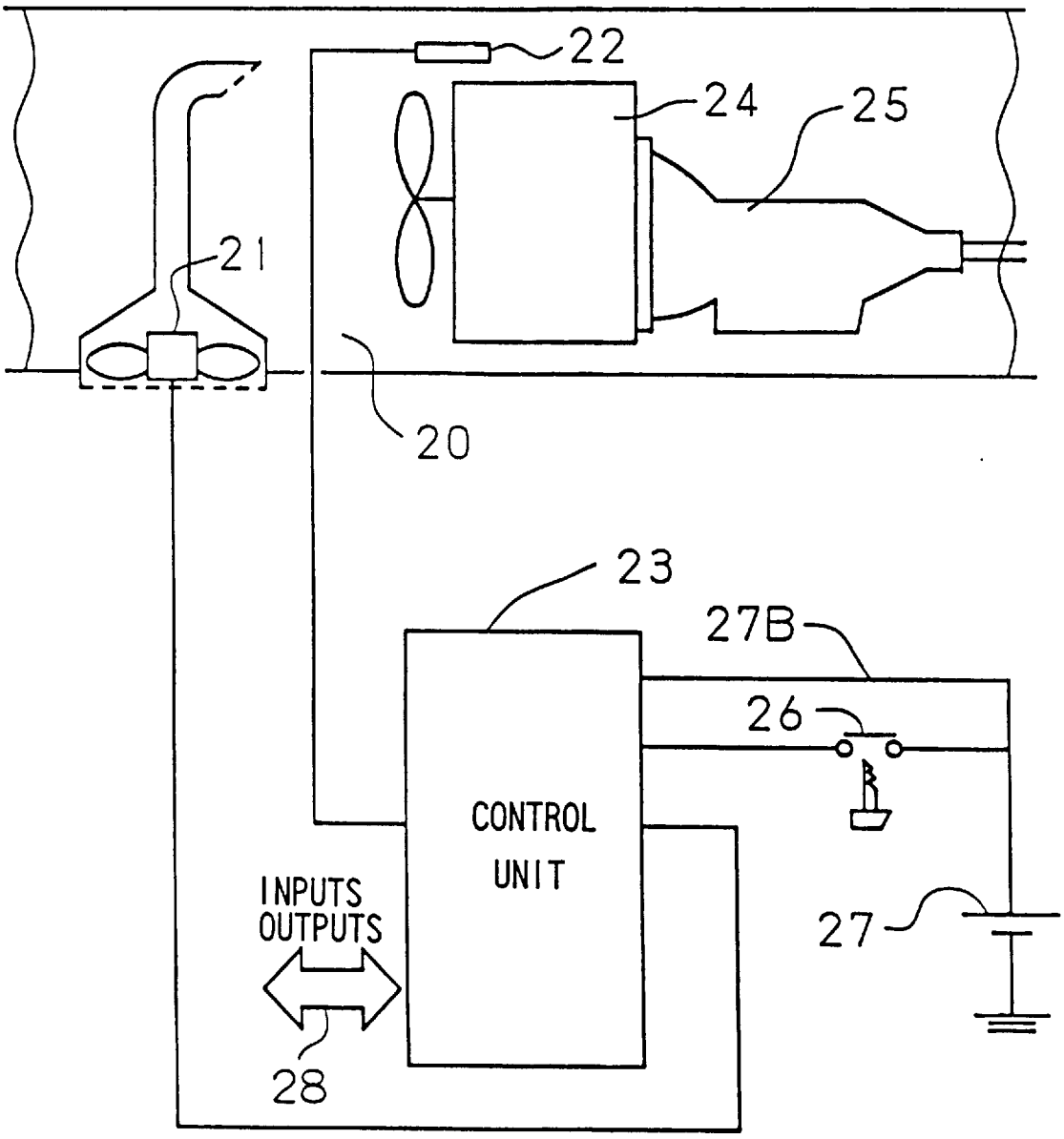
FIG. 2 is an explanatory view showing the construction of a control device according to the first embodiment of the invention.
Figure 3:
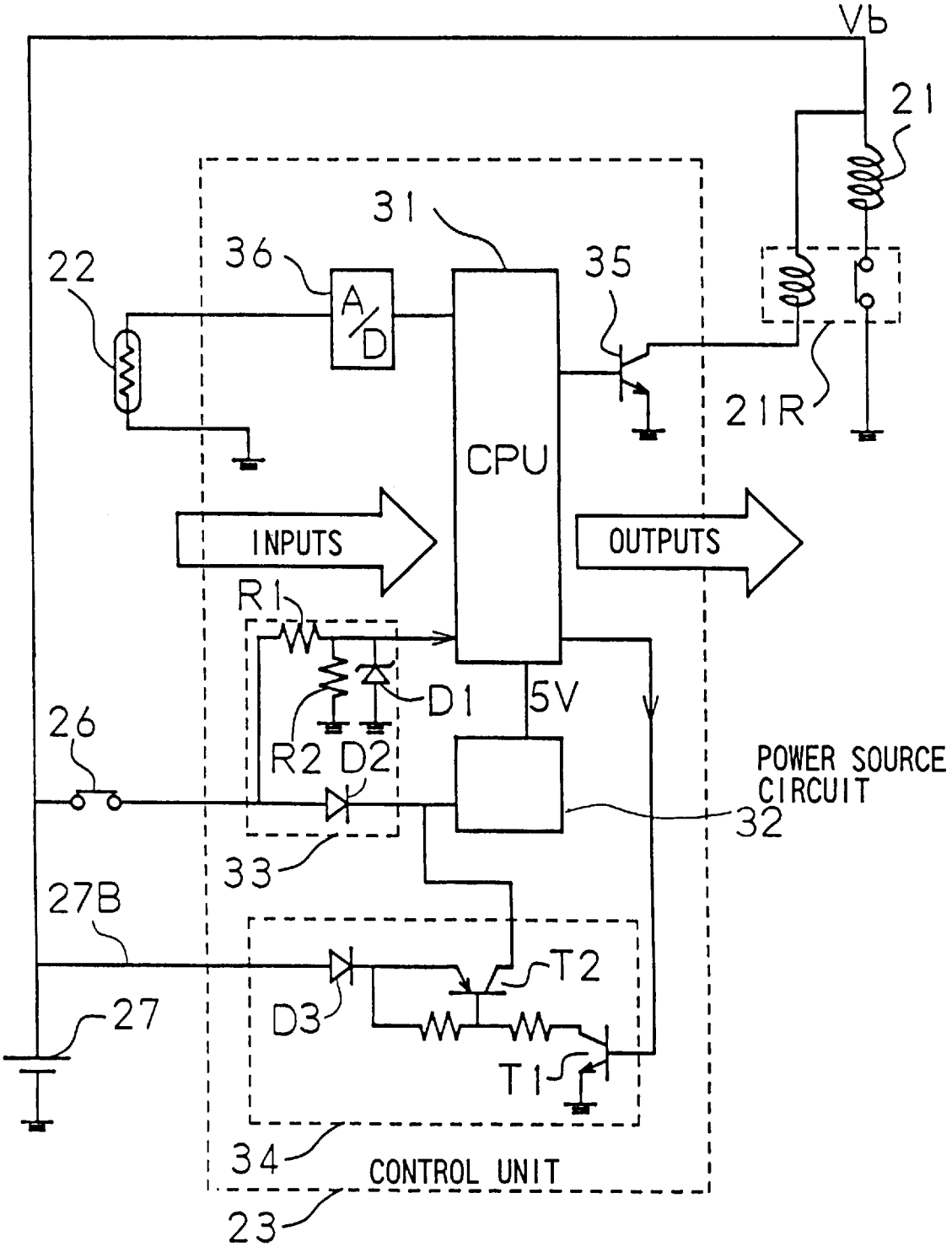
FIG. 3 is a circuit diagram of the first embodiment.
Figure 4:
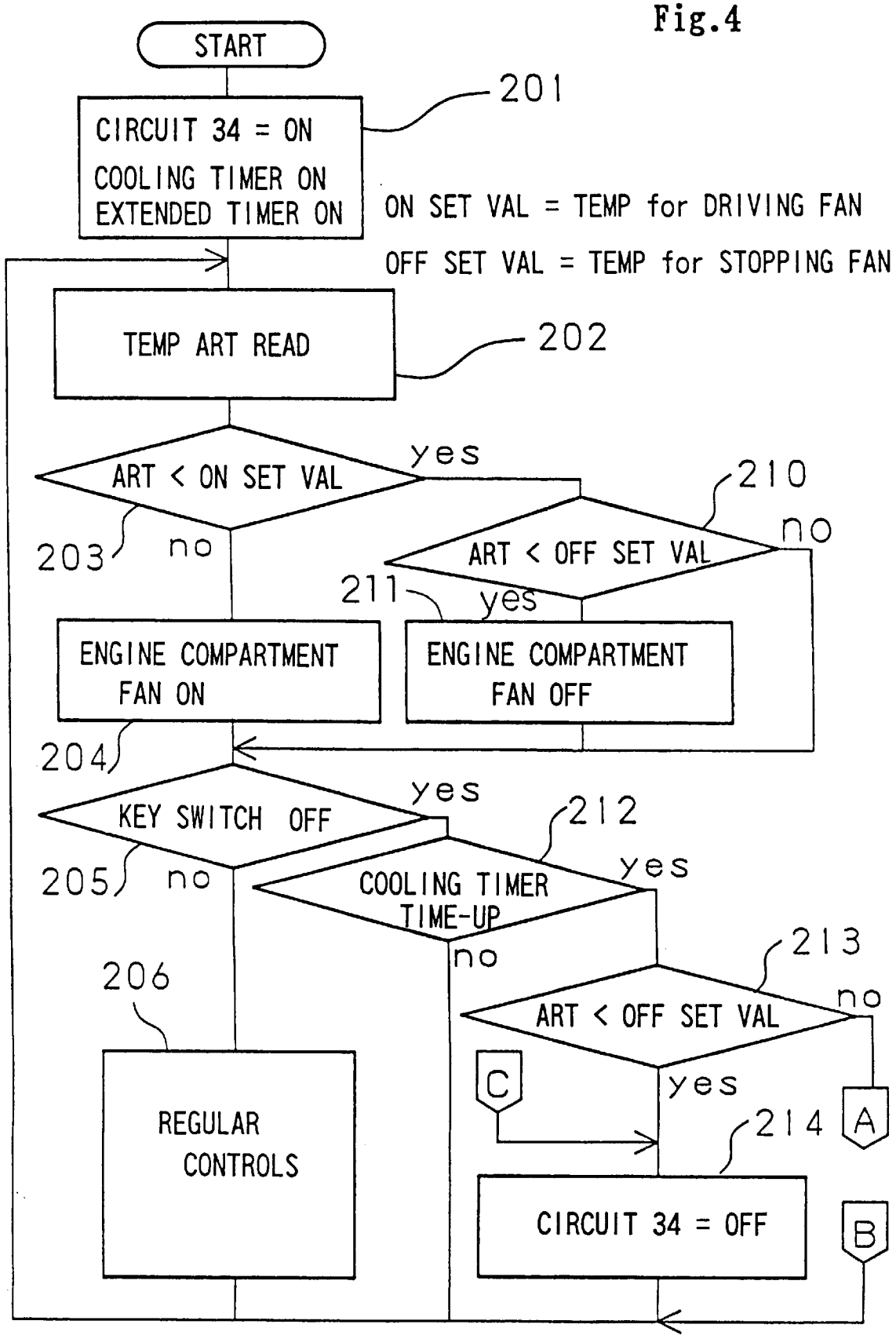
FIG. 4 is a flow chart of processing.

Referring to FIGS. 2 through 6, there will be described one preferred embodiment of the present invention in the form of a control device for controlling a fan in an engine compartment of an automobile. FIG. 2 is a view used for explaining the construction of the device of this embodiment, and FIG. 3 is a circuit diagram. FIGS. 4, 5A and 5B are flow charts of processing, wherein FIG. 5A is an extended timer processing, and FIG. 5B is a timer count processing. FIG. 6A and 6B are time charts used for controlling the fan, wherein FIG. 6A is a time chart in the case of rapid cooling, while FIG. 6B is a time chart in the case of slow cooling.

Referring first to FIG. 2, an engine compartment 20 is formed under a floor of a passenger room of an automobile (not shown). An engine 24 and an automatic transmission are housed in the engine compartment 20. An engine compartment fan 21 is positioned in the engine compartment 20 substantially in the middle portion of the vehicle body. The engine compartment fan 21 forces air having a high temperature to be exhausted out of the engine compartment 20, and permits a cool air to enter the engine compartment 20 from outside. An engine compartment temperature sensor 22 is disposed in the engine compartment 20. The temperature sensor 22 is adapted to output or generate analog signals corresponding to temperature levels in the engine compartment 20.

A control unit 23 is provided in the passenger room of the automobile. The control unit 23 executes, as an unit system, general control programs mainly for controlling the engine 24, and is connected through a plurality of inputs and outputs 28 to numerous sensors and auxiliary equipment (not shown). The control unit 23 is connected to a battery 27 through a key switch 26, and operates with power supplied from the battery 27. The control unit 23 starts operating at the same time that the key switch 26 is placed in its ON state (is turned ON). The control unit 23 is adapted to control ON and OFF states of the engine compartment fan 21 according to an engine compartment fan control program included in engine control programs. The control unit 23 keeps controlling the engine compartment fan 21, with power supplied from the battery 27 through a by-pass line 27B, even after the key switch 26 is placed in the OFF state.

Referring next to FIG. 3, the control unit 23 includes a processing block (central processing unit=CPU) 31, a power source circuit 32, a key switch detecting circuit 33, a power source connecting and disconnecting circuit 34, an A/D converter 36, a driver 35 and other components. The power source circuit 32 receives electric power supplied from the battery 27 and generates a power source voltage of five volts. The CPU 31 operates with the five-volt source voltage applied by the power source circuit 32. The A/D converter 36 converts analog output signals received from the temperature sensor 22 into digital signals, which are then received by the CPU 31.

The CPU 31 determines the temperature of the air in the engine compartment 20 on the basis of the output signal of the temperature sensor 22 received through the A/D converter 36. If the air temperature exceeds a predetermined limit value (ON-setting value), the CPU 31 starts operating the engine compartment fan 21. If the air temperature becomes lower than another limit value (OFF-setting value), the CPU 31 stops the engine compartment fan 21. More specifically, the CPU 31 actuates a driver 35 (in the illustrated example a transistor) so as to place a fan relay 21R in its ON state, so that the engine compartment fan 21 is turned on. The CPU 31 then turns off the driver 35 so as to turn off or stop the engine compartment fan 21. The engine compartment fan 21 is directly connected the output of the battery 27.

The CPU 31 determines the ON/OFF state of the key switch 26 on the basis of an output from a key switch detecting circuit 33. While the key switch 26 is ON, a Zener diode D1 prevents a voltage between contacts (nodes) of a stack of resistances R1 and R2 from being excessively high, and maintains the voltage at a predetermined high level. When the key switch 26 is turned off, a voltage on the side of the by-pass line 27B is blocked by the diode D2, and the voltage of the whole stack of the resistances R1 and R2 is reduced to a predetermined low level.

The output voltage from the battery 27, which passes through the by-pass line 27B, is received by the power source circuit 32, through a diode D3 and a transistor T2, when the transistor T2 is in its ON state. The transistor T2 is switched to the ON state when the CPU 31 turns on the transistor T1. Namely, while the transistor T2 is ON, the power source circuit 32 keeps generating the five-volt source voltage, with a supply of electric power from the battery 27 through the by-pass line 27B and a power source connecting and disconnecting circuit 34, even if the key switch 26 is turned off. This permits the CPU 31 to keep performing its functions, to control the engine compartment fan 21 in the same manner as before the key switch 26 is turned off.

The CPU 31 performs various arithmetic manipulations according to processing programs stored therein, using numerous input signals, to generate numerous output signals. A program for controlling the engine compartment fan 21 is a part of the processing programs stored in the CPU 31. For example, when the key switch 26 is turned on, the control program for the engine compartment fan 21 is initiated together with other control programs of step 206 as shown in FIG. 4. In step 201, the power source connecting and disconnecting circuit 34 (transistor T1) is turned on, and a cooling timer and an extended timer used in this program are set to their initial values. In the following steps, therefore, the source voltage of the power source circuit 32 is maintained at 5 V and the CPU 31 keeps operating until the CPU 31 itself turns off the power source connecting and disconnecting circuit 34 (transistor T1).

The cooling timer counts a time for observing a temperature rise in the engine compartment 20 after the key switch 26 is turned off, and keeps controlling the fan 21. The cooling timer is set to the initial value, i.e., 300 counts corresponding to 5 minutes.

The extended timer counts a time for which the fan 21 is kept controlled in the case where the cooling of the engine compartment 20 is not completed at the point of time when the cooling timer times out. The extended timer is also set to the initial value, i.e., 300 counts corresponding to 5 minutes.

In step 202, the out put of the engine compartment temperature sensor 22 is read out (retrieved) to determine the temperature ART of the engine compartment 20. If the temperature ART is determined to be higher than a predetermined ON-setting value in step 203, step 204 is implemented to start the engine compartment fan 21. If the temperature ART is determined to be lower than the ON-setting value in step 203, and is then determined to be lower than a predetermined OFF-setting value in the next step 210, step 211 is implemented to stop the engine compartment fan 21. If the temperature ART is determined to be higher than the OFF-setting value in step 210, the control flow skips step 211 and goes to step 205. As a result, the engine compartment fan 21 is kept in the ON state.

Step 205 is implemented to determine whether the key switch 26 is in the ON or OFF state. If the key switch 26 is ON, other regular control programs are carried out in step 206. When the key switch 26 is OFF, on the other hand, the following steps using the cooling timer and extended timer are executed.

Step 212 is implemented to determine whether the cooling timer is counting the time or has timed out. If the cooling timer is in the course of counting, steps 202–205 and 210–211 are repeated. If the cooling timer times out, on the other hand, the temperature ART of the engine compartment 20 is compared with the above-indicated OFF setting value.

If the temperature ART of the engine compartment 20 is lower than the OFF setting value, which means that the cooling has completed, the power source connecting and disconnecting circuit 34 is turned off in step 214, to terminate the entire operation and power consumption of the control unit 23 including the CPU 31.

If the temperature ART of the engine compartment 20 is higher than the OFF setting value, which means that the engine compartment 20 has not been cooled enough, the extended timer is employed to continue control of the engine compartment fan 21.

And, step 221 as shown in FIG. 5A is executed to determine whether the extended timer is counting the time or has timed up. If the extended timer is in the course of counting, steps 202–205 and 210–211 are repeated. If the extended timer has timed up, the power source connecting and disconnecting circuit 34 is immediately turned off in step 214, to terminate the entire operation and power consumption of the control unit 23 including the CPU 31.

The control routines as shown in FIGS. 4 and FIG. 5A are interrupted each second by an interruption handling routine as shown FIG. 5B. In the routine of FIG. 5B, the cooling timer starts counting when the key switch 26 is turned off, and the extended timer starts counting when the cooling timer has timed out.

Step 222 is executed to determine whether the key switch 26 is in the ON or OFF state. If the key switch is ON, the count value of each of the cooling timer and extended timer is not changed, and kept at the initial value. If the key switch 26 is OFF, on the other hand, the count value of the cooling time is reduced one by one, i.e. decremented, each second in step 225, until timeout of the cooling timer is detected in step 223. After the timeout of the cooling timer is recognized in step 223, step 226 is executed to reduce the count value of the extended time one by one each second in step 226, until timeout of the extended timer is recognized in step 224.

Referring next to FIGS. 6(*a*) and 6(*b*), there will be described actual operation of the engine compartment fan 21 that is controlled according to the above-described routines.

Figure 6A:
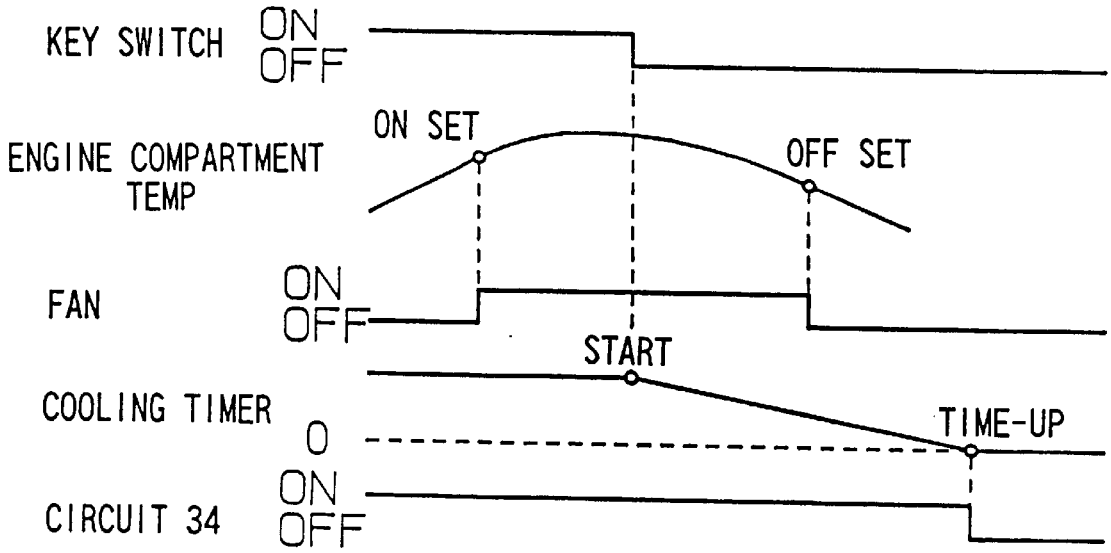
FIG. 6A is a time chart of control of an engine compartment fan.

In the case as shown in FIG. 6A, the engine compartment fan 21 is started when the temperature of the engine compartment 20 exceeds the ON setting value while the key switch 26 is in the ON state, that is, while the vehicle is running or being operated. The key switch 26 is turned off after the temperature in the engine compartment 20 become settled due to the effect of the engine compartment fan 21.

After the key switch 26 is turned off, the engine compartment fan 21 is stopped at the point of time when the temperature of the engine compartment 20 falls below the OFF setting value. The power source connecting and disconnecting circuit 34 is then turned off at the point of time when the cooling timer times out.

In this case, the extended timer is not started since the temperature of the engine compartment 20 is less than the OFF setting value when the cooling timer times out.

Figure 6B:
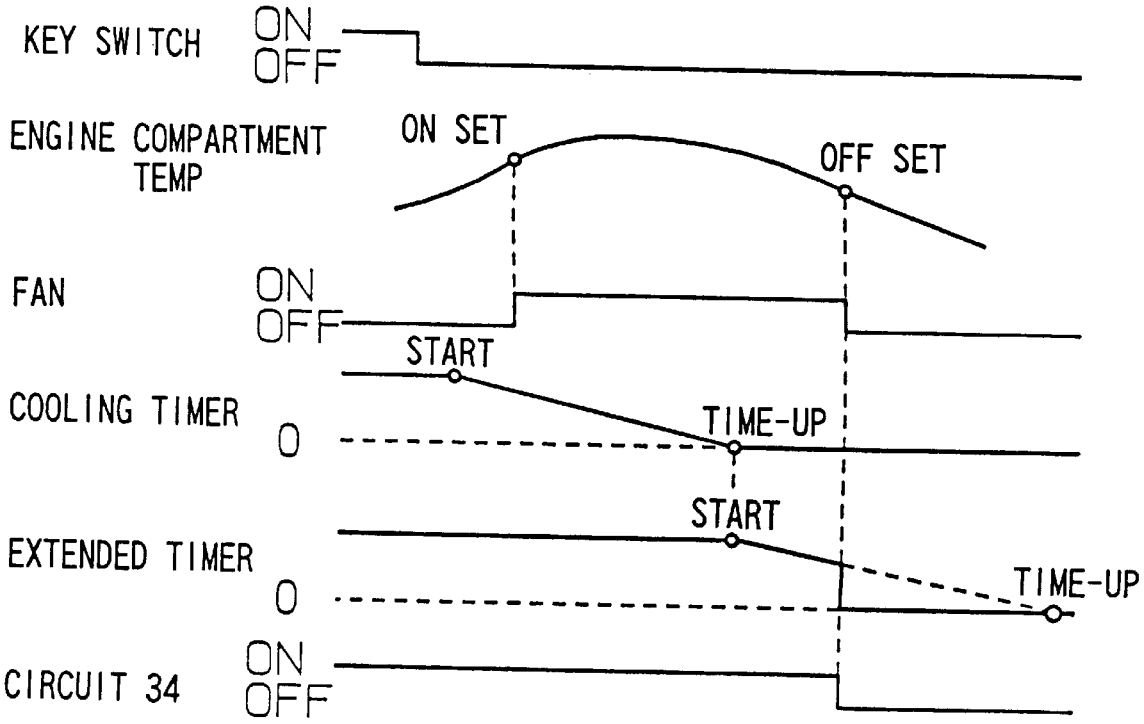
FIG. 6B is a time chart of control of an engine compartment fan.

In the case as shown in FIG. 6B, the engine compartment fan 21 is started when the temperature of the engine compartment 20 exceeds the ON setting value after the key switch 26 is turned off. In this case, the temperature in the engine compartment 20 keeps rising even after the engine compartment fan 21 is started, and the temperature in the engine compartment 20 is above the OFF-setting value at the point of time when the cooling timer times out.

Following the timeout of the cooling timer, the extended timer starts counting. The engine compartment fan 21 is then stopped when the temperature in the engine compartment 20 falls below the OFF-setting value before the extended timer times out, and the power source connecting and disconnecting circuit 34 is immediately turned off.

Even in the case where the temperature in the engine compartment 20 is above the OFF-setting value at the point of time when the extended timer times out, due to delay in cooling the engine compartment 20, the engine compartment fan 21 and the power source connecting and disconnecting circuit 34 are immediately turned off so as to avoid further consumption of the battery.

As the control device according to the first embodiment is constructed as described above, with the control of the engine compartment fan, the temperature in the engine compartment is prevented from rising after the key switch is turned off, whereby the fuel does not vaporize in the fuel pump or pipe, and the engine can be re-started without difficulty.

Further, the control unit starts the engine compartment fan when it determines or detects a temperature rise in the engine compartment, and stops the fan when it determines a temperature fall in the engine compartment. Thus, the engine compartment fan can be controlled more precisely in view of the actual circumstances, as compared with the case where a timer is used to operate the engine compartment fan for a fixed period of time after the key switch is stopped. Namely, the engine compartment fan is not operated when the engine compartment has a sufficiently low temperature, thus avoiding unnecessary consumption of the battery. In addition, the control device does not continue the operation of the engine compartment fan once cooling of the engine compartment has been completed.

Where the cooling of the engine compartment is delayed because the key switch is turned off immediately after the vehicle is operated or driven with high power for a long time, in a high-temperature atmosphere, for example, the engine compartment fan is kept operated until the temperature is actually reduced, to assure sufficient cooling of the engine compartment.

Moreover, since the temperature used for staring the engine compartment fan is set to be lower than the temperature used for stopping the fan in the above-described control routine, thus giving a hysteresis characteristic to the operation of the engine compartment fan, not merely a single temperature level but also temperature rise and fall in the engine compartment are detected. This ensures reliable starting of the fan during a temperature rise in the engine compartment, and avoids meaningless operation of the fan, in favor of natural cooling, during a temperature fall in the engine compartment. At the same time, the engine compartment fan is prevented from being repeatedly turned on and off.

In the above-described control device, the cooling timer is used to stop controlling the engine compartment fan, and turn off the power source of the control unit itself. After the power source is turned off, therefore, the power consumption of the control unit and associated sensors is zeroed, with a result of no consumption of the battery, as in the case where all systems are stopped upon turn-off of the conventional key switch. This eliminates a concern about battery exhaustion, which may otherwise occur after the vehicle is not operated for a long period of time.

Where the temperature in the engine compartment cannot be lowered enough within the set time of the cooling timer, the extended timer is initiated, to keep cooling the engine compartment, so that the engine compartment can be surely cooled down. The use of the extended timer prevents the control unit from being held on uselessly for an extended time after the cooling of the engine compartment is completed early, and is thus advantageous over the use of a cooling timer which is initially set to a relatively long time. Consequently, the power source can be shut off early, leading to power saving.

Where the cooling is not completed at the point of time when the extended timer times out, the power source of the control unit is immediately shut off, to avoid further consumption of the battery. This case might happen because the temperature of the ambient atmosphere is extraordinarily high, or for other reasons, and therefore there is no benefit in keeping operating the engine compartment fan unlimitedly.

The cooling system for the engine compartment having the above-described functions can be achieved by adding only a small number of components to the conventional control system, and adding a small number of program steps to be executed by the control unit.

The components to be added are only a circuit for supplying a power source through a by-pass line, and a circuit for detecting the ON/OFF state of the key switch. The only change in the wiring on the vehicle body is that a power source line which does not pass the key switch is provided between the battery and the control unit. It is not necessary to change the engine compartment fan and its ON-OFF control circuit.

The program steps to be added are only timer counting steps and a step for controlling the ON and OFF state of the by-pass circuit. It is not necessary to change the control system for controlling the ON and OFF state of the engine compartment fan.

While the engine compartment fan is controlled by the control unit after the key switch is turned off in the first embodiment, the on-vehicle load or equipment to be controlled is not limited to the engine compartment fan. For example, a foot light may be turned on for a predetermined period of time, upon detection of darkness outside the vehicle, so as to meet the convenience of the vehicle operator when leaving the automobile. Another example of the on-vehicle load is an alarm system adapted to detect slipping of the vehicle body or rolling of vehicle wheels, and caution the vehicle operator to deal with the slipping or rolling before leaving the automobile.

While the first embodiment is concerned with cooling of an engine compartment in an automobile having a one-box type vehicle body, a similar cooling operation may be carried out with respect to engine compartments having other structures, including one of a general sedan type in which an engine is covered with a bonnet.

Figure 7:
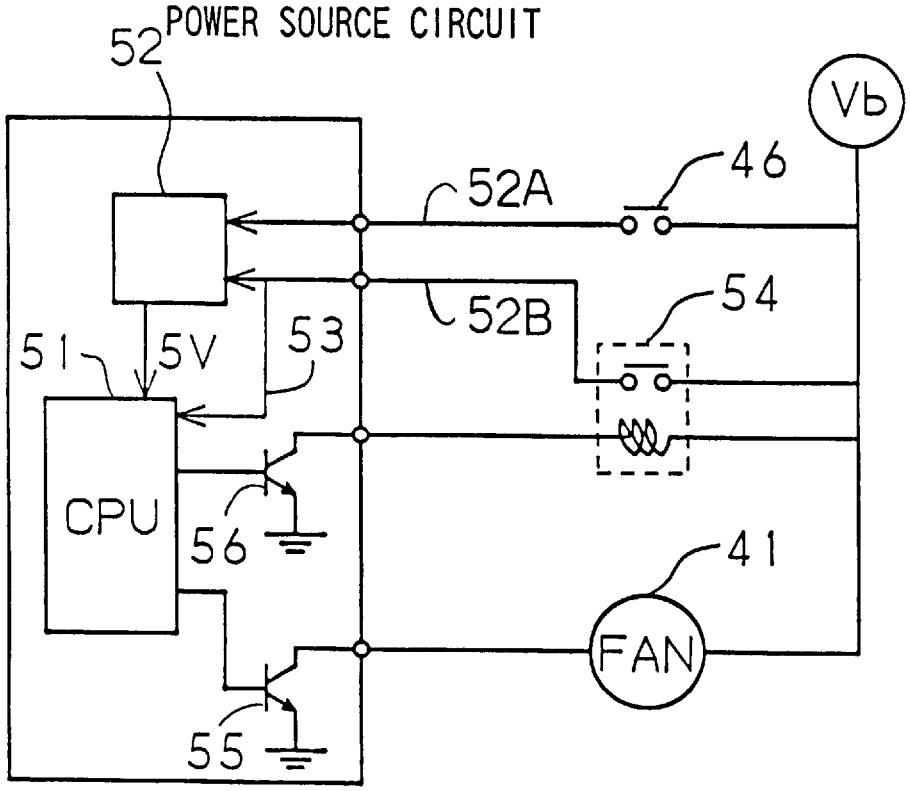
FIG. 7 is a circuit diagram of the second embodiment.

FIG. 7 is a view for explaining control of an engine compartment fan according to the second embodiment. While the engine compartment fan is controlled in the same manner as in the first embodiment, a relay 54 is used in the second embodiment as a component for permitting or inhibiting the power supply through the by-pass line.

In FIG. 7, a CPU 51 is actuated by a source voltage of five volts supplied from a power source circuit 52. To the power source circuit 52, there are connected a line 52B for supplying a battery output voltage through the relay 54, as well as a line 52A for supplying a battery output voltage through a key switch 46.

The contact of the relay 54 is closed when a driver 56 is turned on by the CPU 51. The CPU 51 turns on the driver 56 at the same time that the key switch 46 is turned on, so that an engine compartment fan 41 can be kept controlled whenever the key switch 46 is turned off. The engine compartment fan 41 driven by the battery voltage is started when the CPU 51 turns on or activates a driver 55, and is stopped when the CPU 51 turns off the driver 55.

In the control device according to the second embodiment as described above, the engine compartment fan 41 is kept controlled even after the key switch 46 is turned off, to achieve sufficient cooling of the engine compartment. The control of the fan 41 is completed upon completion of cooling of the engine compartment or upon the lapse of a preset time, and the CPU 51 turns off the relay 54, to avoid unnecessary consumption of the battery. This second embodiment yields the same effects as provided by the first embodiment.

According to the present invention, the CPU or control unit is able to continue desired control of the on-vehicle equipment after the key switch is turned off, with the same degree of accuracy or subtleness as before the key switch is turned off. The control units then turns off the switching circuit and terminates its own power consumption after the desired control of the on-vehicle equipment is completed, thus avoiding unnecessary consumption of the on-vehicle battery, and allowing the engine to be re-started without difficulty.

The control device for performing the above function involve minimum changes in their construction, and requires no sensor and timer to be newly added. Further, only a few steps need to be added to the control program executed by the control unit, and original processing steps for controlling the on-vehicle equipment before the key switch is turned off can be used as steps required for controlling the equipment after the key switch is turned off.

With the use of timer counting processing, the circumstances of the on-vehicle equipment are observed even after the equipment is turned off, during a certain period of time after the key switch is turned off, so that the on-vehicle equipment can be effectively controlled depending upon changes of the circumstances. Further, only a few steps are added to the original processing program stored in the processing block.

The switching circuit comprising a transistor circuit can be accommodated in the control unit, without requiring any change associated with the switching circuit, in the wiring outside the control unit. Thus, the switching circuit can be easily installed on a vehicle body.

The control of the cooling fan is effected on the basis of the temperature of the engine compartment after the key switch is turned off, whereby a temperature rise and overheating of the engine compartment are prevented, and the engine can be re-started without difficulty after a short time.

The exhaust fan can be controlled after the key switch is turned off, with the same degree of accuracy and subtleness as before the key switch is turned on. Upon completion of the control of the exhaust fan, the processing block turns off the second switching circuit so as to terminate its own power consumption, thus avoiding unnecessary consumption of the on-vehicle battery, and allowing the engine to be re-started without difficulty.

The use of the cooling timer and extended timer for controlling the exhaust fan ensures sufficient cooling of the engine compartment even when it is delayed. Further, the control unit stops its control upon timeout of the extended timer, thus preventing the on-vehicle battery from being unlimitedly consumed or exhausted.

The invention has been described with reference to certain preferred embodiments thereof. It will be understood, however, that modifications and variations are possible within the scope of the appended claims.

What is claimed is:

1. A control device for an automobile comprising:

a first switching circuit for permitting and inhibiting power supply to an engine compartment exhaust fan for exhausting air from an engine compartment;

a processing block for controlling ON and OFF states of the first switching circuit;

a power source circuit for producing a source voltage to the processing block from electric power of an on-vehicle battery supplied through a key switch;

a temperature sensor for detecting an air temperature level in the engine compartment;

a power source sensor for generating an output corresponding to one of ON and OFF states of the key switch; and a second switching circuit provided between the on-vehicle battery and the power source circuit, for permitting power supply through a by-pass line to the power source circuit in response to a command from the processing block;

wherein said processing block includes first means for turning on the second switching circuit before the key switch is turned off, second means for turning on and off the first switching circuit on the basis of an output of the air temperature sensor, third means for determining the ON and OFF states of the key switch on the basis of an output of the power source sensor, and fourth means for turning off the second switching circuit after the engine compartment exhaust fan is kept controlled for a predetermined time period when the key switch is determined to be in the OFF state; and wherein said fourth means comprises means for starting a cooling timer when the key switch is determined in the OFF state, means for turning off the second switching circuit if control of the engine compartment exhaust fan to cool the engine compartment to a desired temperature is completed upon timeout of the cooling timer, and for starting an extended timer if control of the engine compartment exhaust fan to cool the engine compartment to the desired temperature has not been completed, means for turning off the second switching circuit immediately after the control of the exhaust fan to cool the engine compartment to the desired temperature is completed during counting of the extended timer, and means for turning off the second switching circuit upon timeout of the extended timer even if the control of the engine compartment exhaust fan to cool the engine compartment to the desired temperature has not been completed.

* * * * *